US012017119B2

(12) United States Patent
Lee

(10) Patent No.: US 12,017,119 B2
(45) Date of Patent: Jun. 25, 2024

(54) PERMANENT MAGNET RESISTANCE SIMULATION DEVICE

(71) Applicant: CHI HUA FITNESS CO., LTD., Hsinchu County (TW)

(72) Inventor: Chia Jung Lee, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 279 days.

(21) Appl. No.: 17/657,408

(22) Filed: Mar. 31, 2022

(65) Prior Publication Data

US 2023/0310940 A1 Oct. 5, 2023

(51) Int. Cl.

| | |
|---|---|
| ***A63B 24/00*** | (2006.01) |
| ***A63B 21/00*** | (2006.01) |
| ***A63B 21/005*** | (2006.01) |
| ***A63B 21/22*** | (2006.01) |

(52) U.S. Cl.

CPC ..... *A63B 24/0087* (2013.01); *A63B 21/0058* (2013.01); *A63B 21/15* (2013.01); *A63B 21/225* (2013.01); *A63B 2024/0093* (2013.01); *A63B 2220/54* (2013.01)

(58) Field of Classification Search

CPC . A63B 24/0087; A63B 21/0058; A63B 21/15; A63B 21/225; A63B 2024/0093; A63B 2220/54

See application file for complete search history.

(56) References Cited

U.S. PATENT DOCUMENTS 7,682,287 B1 * 3/2010 Hsieh ..... A63B 21/153 482/4

* cited by examiner

*Primary Examiner* — Sundhara M Ganesan
*Assistant Examiner* — Jacqueline N L Loberiza
(74) *Attorney, Agent, or Firm* — Rosenberg, Klein & Lee

(57) ABSTRACT

The permanent magnet resistance simulation device includes: a base; a motor arranged on the base and having a torque output shaft, and having a torque data encoder and a rotational speed controller; a transmission shaft arranged on the base and coaxial with the torque output shaft, and is equipped with a motion data encoder; a pair of flywheels, coupled to the torque output shaft and the transmission shaft, and the pair of flywheels are coupled with a magnet and a magnetic surface; a rope reel arranged on the transmission shaft and is twined with a rope, and a one way clutch is arranged between the rope reel and the transmission shaft; a volute spring arranged on the transmission shaft; and a control system.

7 Claims, 8 Drawing Sheets

PERMANENT MAGNET RESISTANCE SIMULATION DEVICE

BACKGROUND OF THE INVENTION

1. Field of the Invention

The invention relates to a permanent magnet resistance simulation device, especially to one that uses a dual-rotor non-contact torque transmission structure to linearly simulate the motor torque as motion resistance.

2. Description of the Related Art

As showing in FIG. 1, the conventional strength training machine 10 uses the iron weight stack 11 as a load resistance, and allows the user to pull the iron weight stack 11 through the grip bar 12 and the cable 13 to shape healthy muscles, and promote physiological functions and keeping the body healthy; however, the conventional strength training machine has the following shortcomings: 1. The iron weight stack 11 takes up a lot of space, and it is time-consuming and laborious to adjust the load resistance; 2. When the iron weight stack 11 is pulled up by the cable 13 and then put down, it produces loud impact noise; 3. Cannot set the fitness curve to change the load resistance, so the fitness function is limited.

Patent No. TWM697670/U.S. Ser. No. 11/173,343 discloses a "muscle strength training machine", which combines the rope reel on the output shaft of the deceleration mechanism, so that the torque generated by the motor is directly transmitted to the rope reel, which belongs to a "contact torque transmission structure" design, but this design has the following deficiencies: 1. It is necessary to use a larger horsepower motor to provide sufficient motion resistance, 2. Adjusting the motor speed cannot linearly adjust the motion resistance.

SUMMARY OF THE INVENTION

It is a primary objective of the present invention to provide a permanent magnet resistance simulation device that can linearly adjusting the motion resistance by adjusting the motor speed.

In order to achieve the above objectives, the permanent magnet resistance simulation device includes: a base; a motor arranged on the base and having a torque output shaft, and having a torque data encoder and a rotational speed controller; a transmission shaft arranged on the base and coaxial with the torque output shaft, and is equipped with a motion data encoder; a pair of flywheels, coupled to the torque output shaft and the transmission shaft, and the pair of flywheels are coupled with a magnet and a magnetic surface; a rope reel arranged on the transmission shaft and is twined with a rope, and a one way clutch is arranged between the rope reel and the transmission shaft; a volute spring arranged on the transmission shaft; and a control system, which receives the torque data of the torque data encoder and the motion data of the motion data encoder, and sends the motor speed control data to the rotational speed controller.

Also, the control system has a torque data analyzer, a motion data analyzer, a resistance demand setting unit, a torque demand calculation unit and a target rotation speed calculation unit; the torque data analyzer receives the torque data of the torque data encoder, and analyzes out the motor steering data and the motor speed data; the motion data analyzer receives the motion data of the motion data encoder, and analyzes out the transmission shaft steering data, the transmission shaft rotational speed data and the rope pulling length data; the torque demand calculation unit receives the motor steering data and the motor speed data of the torque data analyzer, the transmission shaft speed data and the rope pulling length data of the motion data analyzer, and the resistance demand data input by the resistance demand setting unit are added to calculate the torque demand data; the target rotation speed calculation unit receives the transmission shaft steering data and the transmission shaft rotational speed data of the motion data analyzer, adds the torque demand data of the torque demand calculation unit to calculate the target rotational speed data; the rotational speed controller receives the motor speed data of the torque data analyzer, adds the target speed data of target rotation speed calculation unit to control the speed of the motor.

Also, the magnet is a permanent magnet, and the magnetic surface is a copper sheet. The base has a bottom plate, a torque output shaft bracket, a transmission shaft bracket and a bracket reinforcing plate, and the motor has a reducer. The transmission shaft bracket further has a rope reel cover and transmission shaft bearing seat. The rope reel cover further has a volute spring cover. Between the transmission shaft bearing seat and the transmission shaft have bearings, between the rope reel and the transmission shaft have bearings.

DETAILED DESCRIPTION OF THE PREFERRED EMBODIMENT

Figure 1:
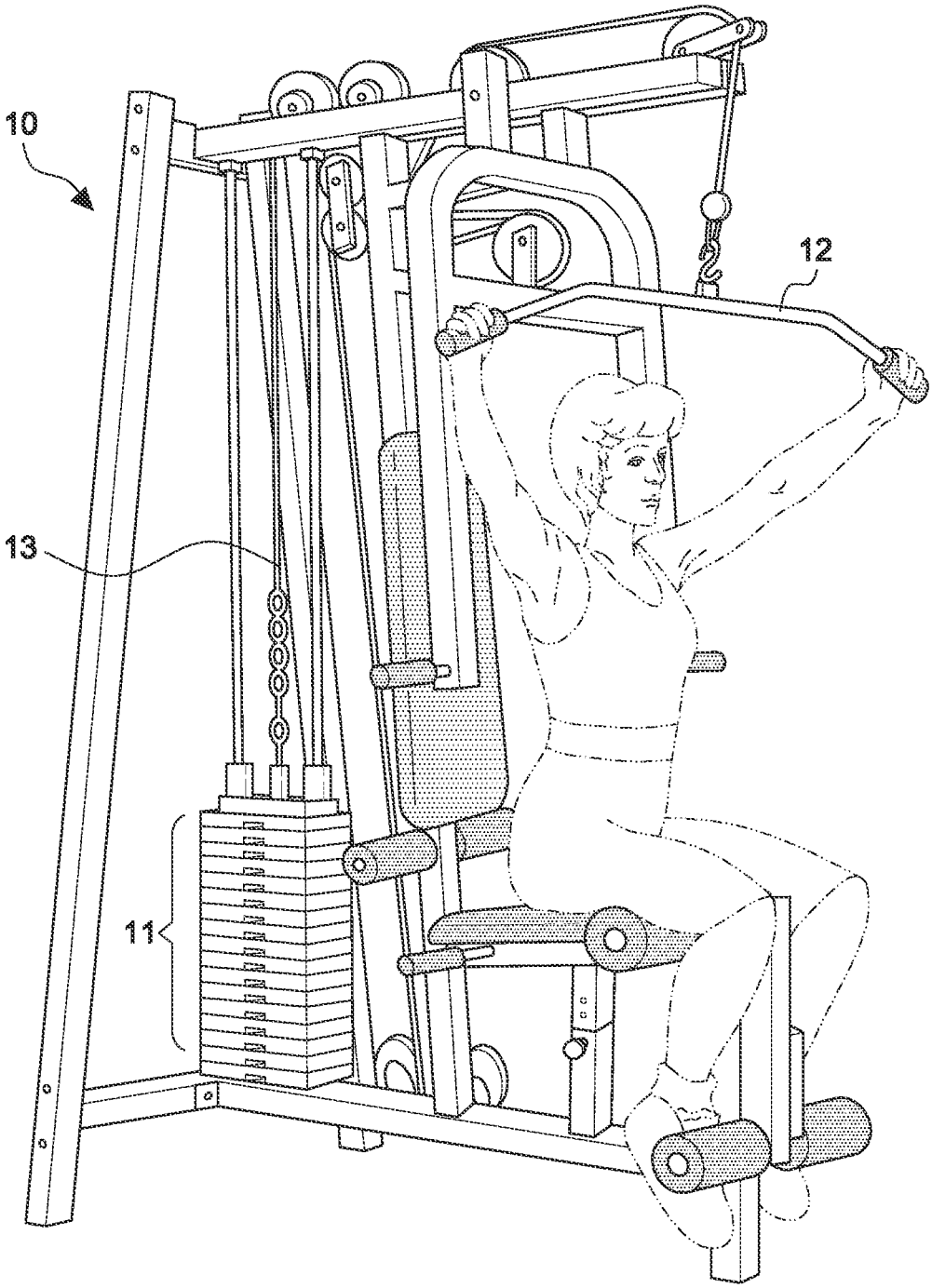
FIG.1 PRIOR ART
FIG. 1 is a perspective views of the conventional strength training machine.
Figure 2:
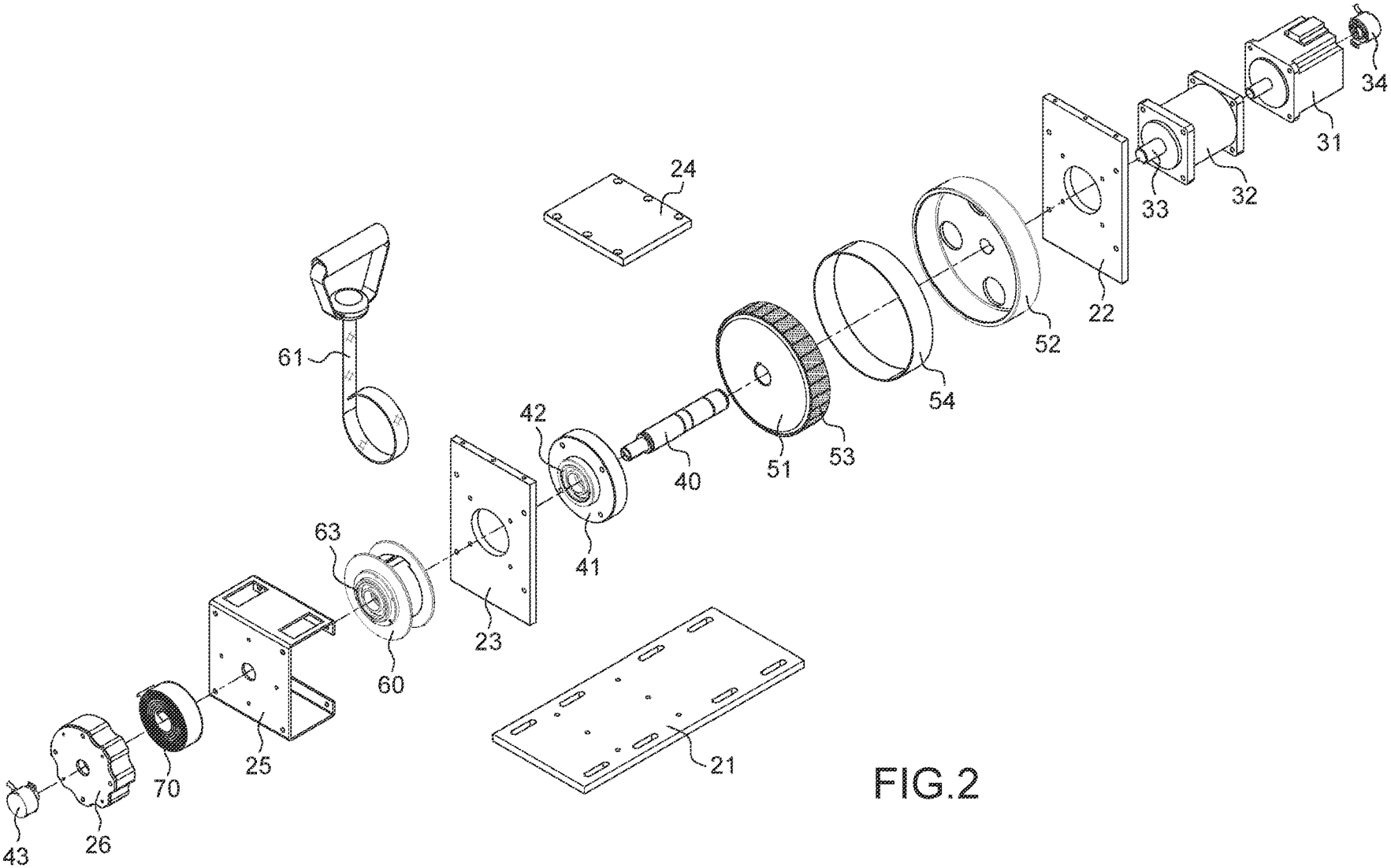
FIG. 2 is an exploded perspective views of the present invention.
Figure 3:
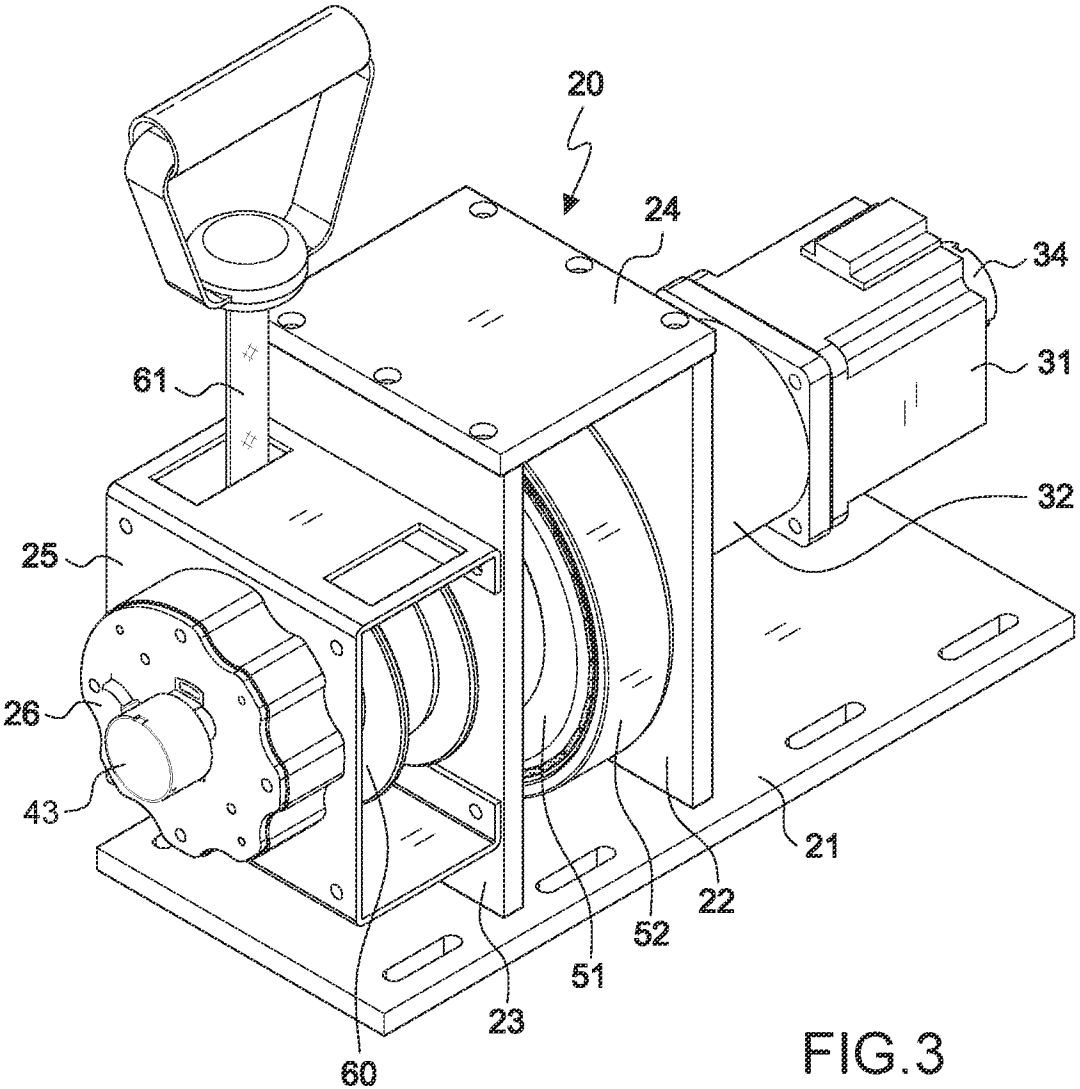
FIG. 3 is an assembly perspective views of the present invention.
Figure 4:
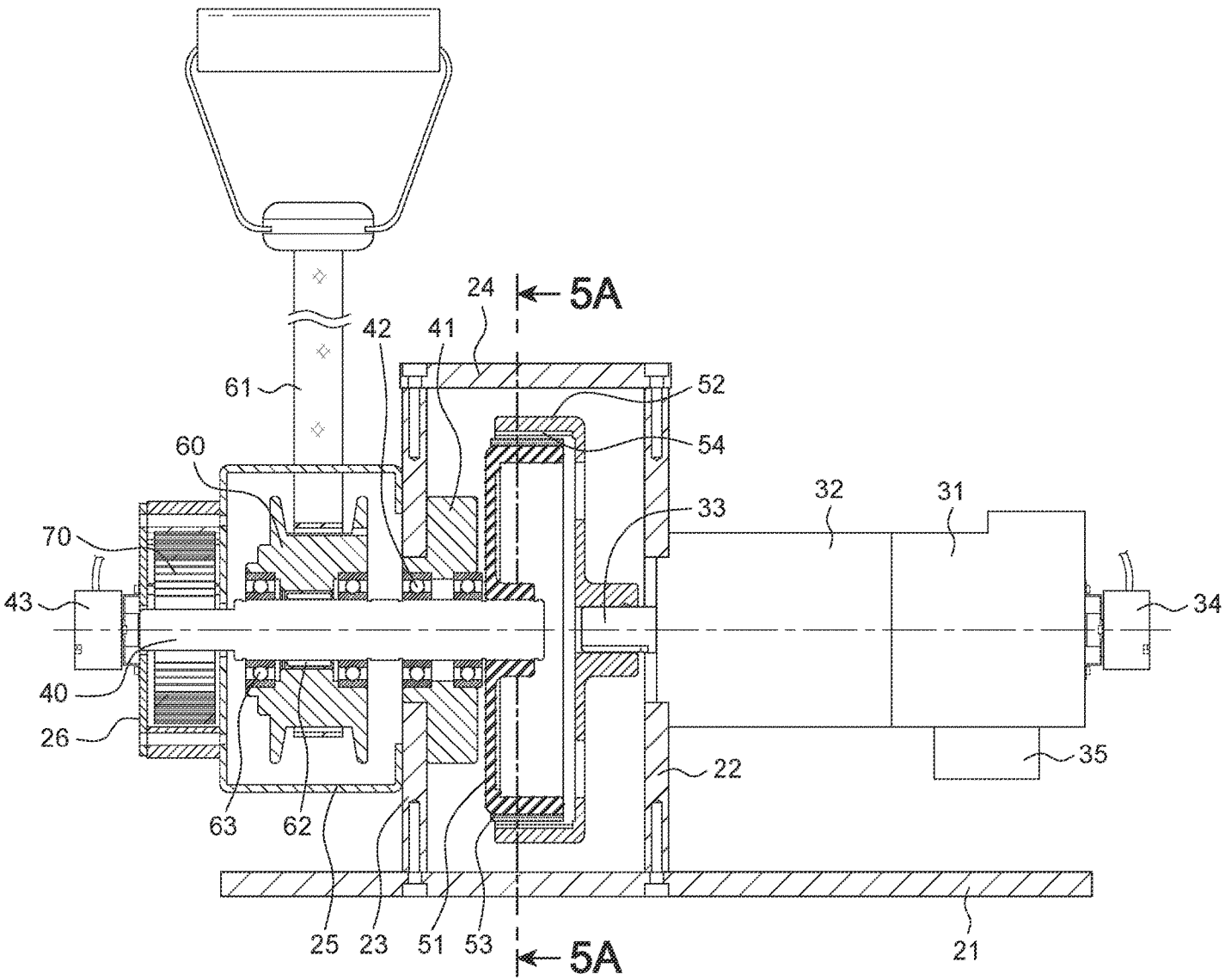
FIG. 4 is a sectional views of the present invention.
Figure 5B:
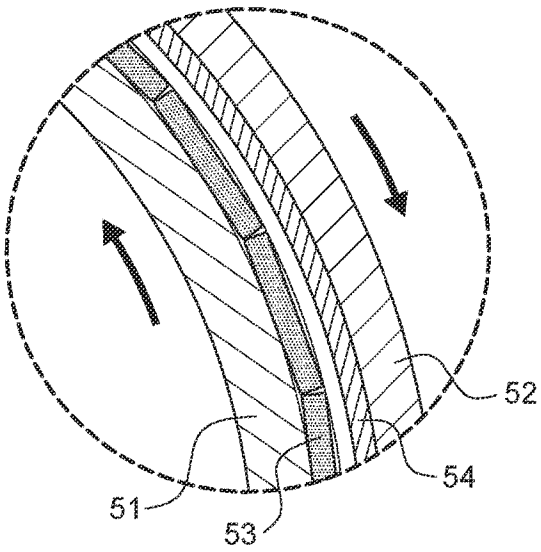
FIG. 5B is a zoom in view of the 5B in FIG. 5A.
Figure 5A:
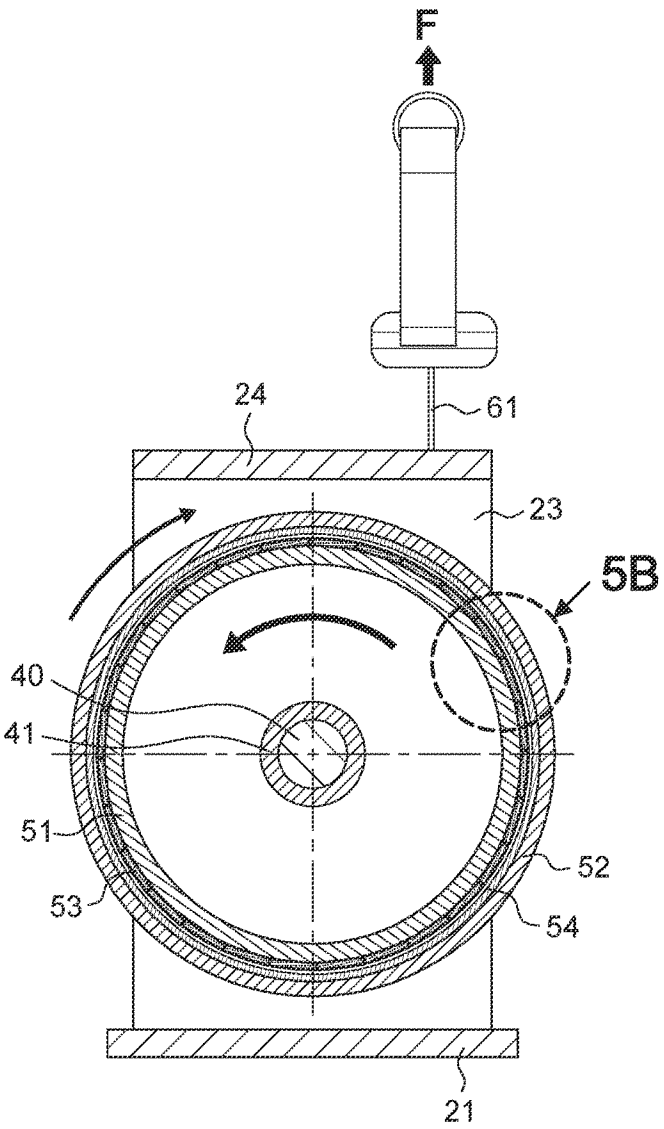
FIG. 5A is a sectional view along line 5A-5A in FIG. 4.
Figure 6:
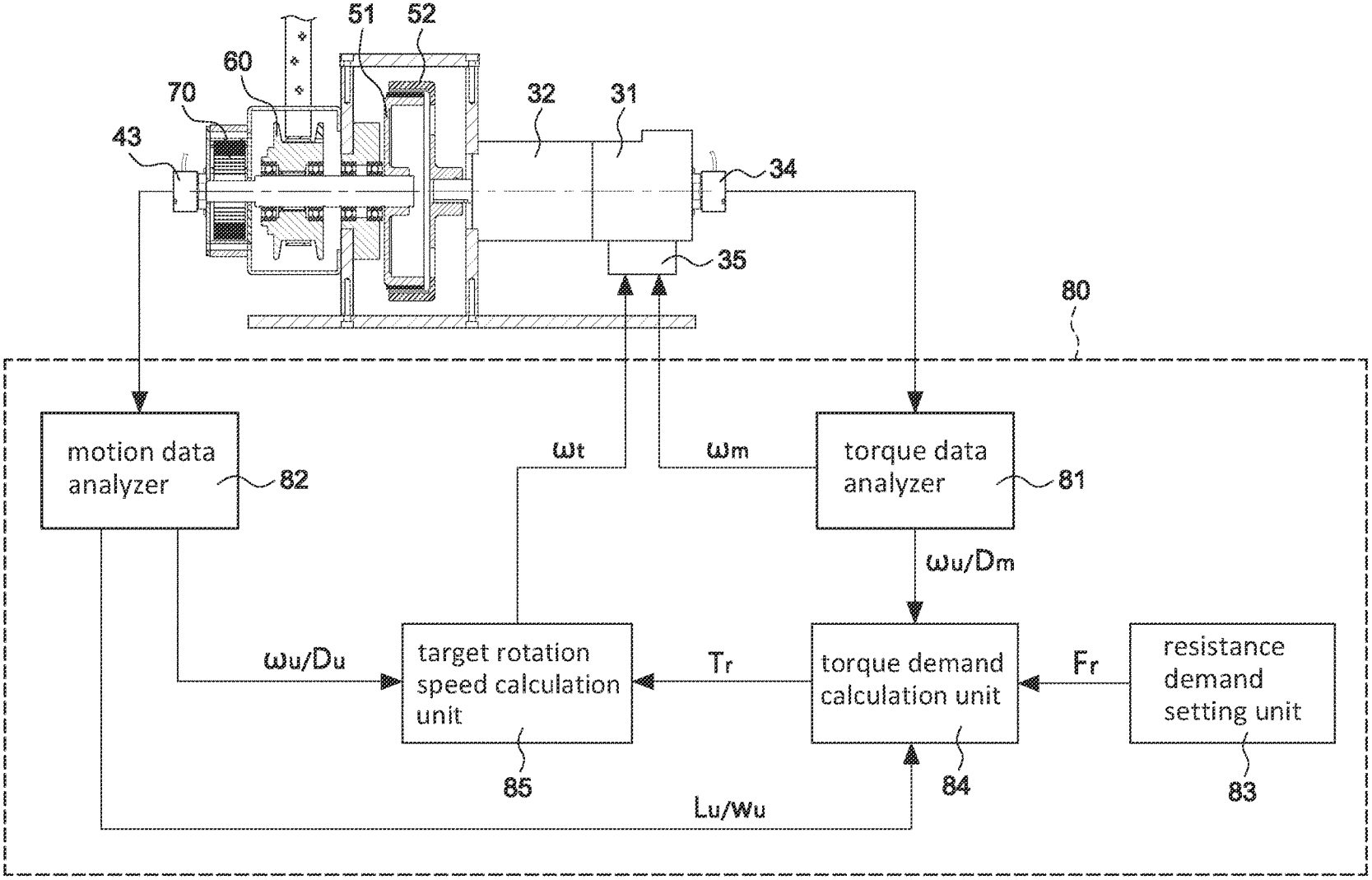
FIG. 6 is a block diagram of the control system of the present invention.

Referring to FIGS. 2-6, the present invention includes: base 20, having a bottom plate 21, a torque output shaft bracket 22, a transmission shaft bracket 23 and a bracket reinforcing plate 24; a motor 31 with a reducer 32, a torque data encoder 34 and a speed controller 35, the reducer 32 arranged on the torque output shaft bracket 22 and having a torque output shaft 33, and the motor 31 is combined to the reducer 32; a transmission shaft 40 arranged on the transmission shaft bracket 23 and coaxial with the torque output shaft 33 by a transmission shaft bearing seat 41, and is equipped with a motion data encoder 43, between the transmission shaft bearing seat 41 and the transmission shaft 40 have bearings 42; a pair of flywheels 51, 52, coupled to the torque output shaft 33 and the transmission shaft 40, and the pair of flywheels 51, 52, are coupled with a magnet 53 and a magnetic surface 54, the magnet 53 is a permanent magnet, the magnetic surface 54 is a copper sheet; a rope reel 60 arranged on the transmission shaft 40 and is twined with a rope 61, a one way clutch 62 and a bearing 63 are arranged between the rope reel 60 and the transmission shaft 40, and the transmission shaft bracket 23 further has a rope reel cover 25 relative to the rope reel 60; a volute spring 70 arranged on the transmission shaft 40, and the rope reel cover 25 further has a volute spring cover 26 relative to the volute spring 70; a control system 80, which receives the torque data of the torque data encoder 34 and the motion data of the motion data encoder 43, and sends the motor speed control data to the rotational speed controller 35.

Then, the control system 80 has a torque data analyzer 81, a motion data analyzer 82, a resistance demand setting unit 83, a torque demand calculation unit 84 and a target rotation speed calculation unit 85; the torque data analyzer 81 receives the torque data of the torque data encoder 34, and analyzes out the motor steering data Dm and the motor speed data ωm; the motion data analyzer 82 receives the motion data of the motion data encoder 43, and analyzes out the transmission shaft steering data Du, the transmission shaft rotational speed data d u and the rope pulling length data Lu; the torque demand calculation unit 84 receives the motor steering data Dm and the motor speed data ωm of the torque data analyzer 81, the transmission shaft speed data ωu and the rope pulling length data Lu of the motion data analyzer 82, and the resistance demand data Fr input by the resistance demand setting unit 83 are added to calculate the torque demand data Tr; the target rotation speed calculation unit 85 receives the transmission shaft steering data Du and the transmission shaft rotational speed data ωu of the motion data analyzer 82, adds the torque demand data Tr of the torque demand calculation unit 84 to calculate the target rotational speed data ωt; the rotational speed controller 35 receives the motor speed data ωm of the torque data analyzer 81, adds the target speed data ωt of the target rotation speed calculation unit 85 to control the speed of the motor 31.

Figure 7:
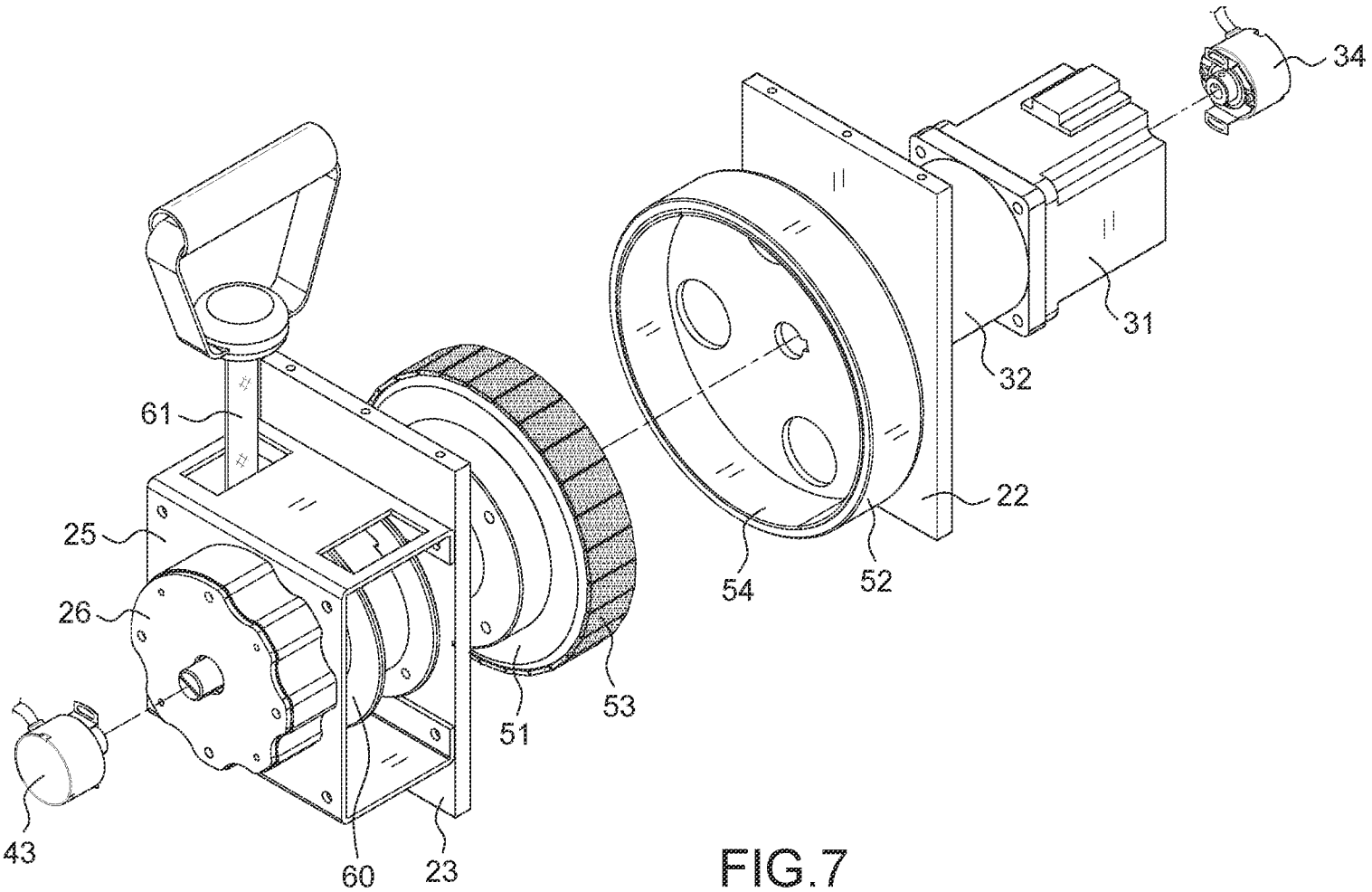
FIG. 7 is an exploded perspective views of the present invention.
Figure 8:
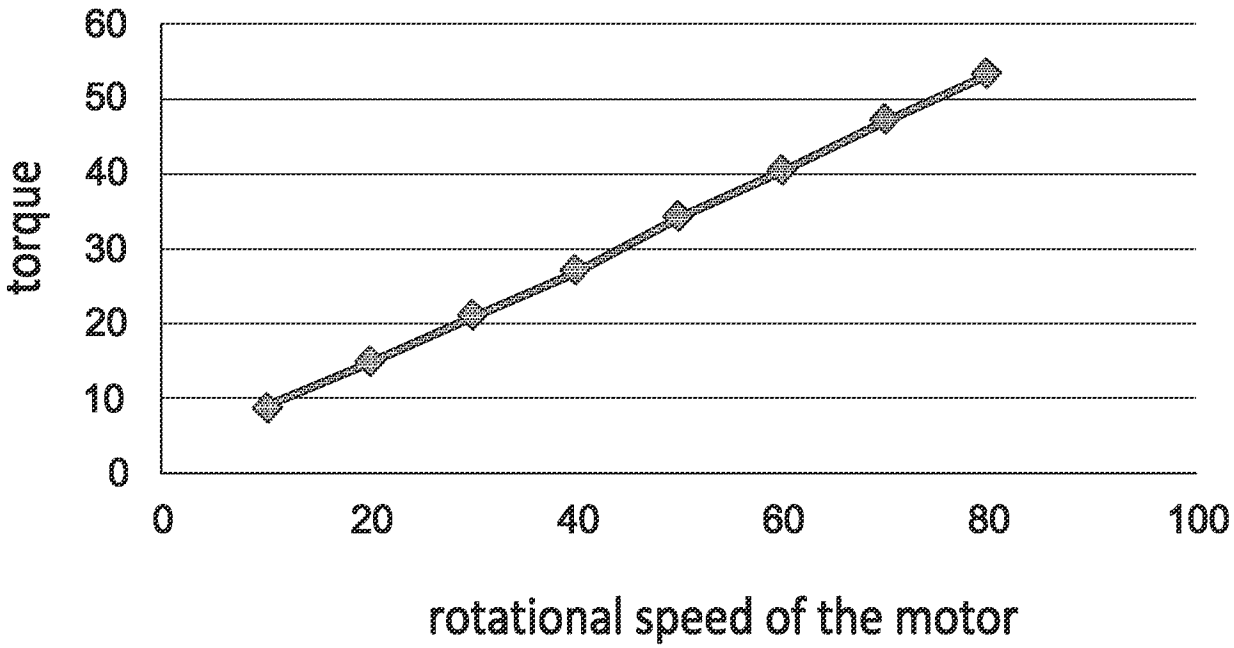
FIG. 8 is a graph showing that the rotational speed of the motor of the present invention is linearly proportional to the torque.

With the feature disclosed above, the present invention uses the motor 31 and the reducer 32 to provide torque, when the rope 61 that twined on the rope reel 60 of the transmission shaft 40 is pulled, the torque can be transmitted to the transmission shaft 40 by a pair of flywheels 51, 52 which coupled to a magnet 53 and a magnetic surface 54, and further simulates into fitness resistance, therefore, the fitness resistance can be adjusted by adjusting the torque output by the motor 31 and the reducer 32; moreover, as FIG. 7 showing, a pair of flywheels 51, 52 are respectively arranged on the torque output shaft 33 (the motor side) and the transmission shaft 40 (the rope reel side), forming a dual-rotor non-contact torque transmission structure; and since the torque generated by the motor 31 and the reducer 32 is linearly proportional to its rotational speed, as FIG. 8 showing, by adjusting the rotational speed of the motor 31 can linearly adjust the magnitude of the torque, and thus the magnitude of the motion resistance; therefore, the present invention has the effect of linearly adjusting the motion resistance by adjusting the rotational speed of the motor.

What is claimed is:

1. A permanent magnet resistance simulation device, comprising:

a base;

a motor arranged on the base and having a torque output shaft, and having a torque data encoder and a rotational speed controller;

a transmission shaft arranged on the base and coaxial with the torque output shaft, and is equipped with a motion data encoder;

a pair of flywheels, coupled to the torque output shaft and the transmission shaft, and the pair of flywheels are coupled with a magnet and a magnetic surface;

a rope reel arranged on the transmission shaft and is twined with a rope, and a one way clutch is arranged between the rope reel and the transmission shaft;

a volute spring arranged on the transmission shaft; and a control system, which receives the torque data of the torque data encoder and the motion data of the motion data encoder, and sends the motor speed control data to the rotational speed controller.

2. The permanent magnet resistance simulation device as claimed in claim 1, wherein the control system has a torque data analyzer, a motion data analyzer, a resistance demand setting unit, a torque demand calculation unit and a target rotation speed calculation unit; the torque data analyzer receives the torque data of the torque data encoder, and analyzes out the motor steering data and the motor speed data; the motion data analyzer receives the motion data of the motion data encoder, and analyzes out the transmission shaft steering data, the transmission shaft rotational speed data and the rope pulling length data; the torque demand calculation unit receives the motor steering data and the motor speed data of the torque data analyzer, the transmission shaft speed data and the rope pulling length data of the motion data analyzer, and the resistance demand data input by the resistance demand setting unit are added to calculate the torque demand data; the target rotation speed calculation unit receives the transmission shaft steering data and the transmission shaft rotational speed data of the motion data analyzer, adds the torque demand data of the torque demand calculation unit to calculate the target rotational speed data, the rotational speed controller receives the motor speed data of the torque data analyzer, adds the target speed data of the target rotation speed calculation unit to control the speed of the motor.

3. The permanent magnet resistance simulation device as claimed in claim 2, wherein the magnet is a permanent magnet, and the magnetic surface is a copper sheet.

4. The permanent magnet resistance simulation device as claimed in claim 3, wherein the base has a bottom plate, a torque output shaft bracket, a transmission shaft bracket and a bracket reinforcing plate, and the motor has a reducer.

5. The permanent magnet resistance simulation device as claimed in claim 4, wherein the transmission shaft bracket further has a rope reel cover and transmission shaft bearing seat.

6. The permanent magnet resistance simulation device as claimed in claim 5, wherein the rope reel cover further has a volute spring cover.

7. The permanent magnet resistance simulation device as claimed in claim 5, wherein between the transmission shaft bearing seat and the transmission shaft have bearings, between the rope reel and the transmission shaft have bearings.

* * * * *